US008246485B2

(12) United States Patent
Miura et al.

(10) Patent No.: US 8,246,485 B2
(45) Date of Patent: Aug. 21, 2012

(54) GOLF CLUB SHAFT

(75) Inventors: Toshimitsu Miura, Shinagawa-ku (JP); Yoshifumi Nakajima, Shinagawa-ku (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 264 days.

(21) Appl. No.: 12/635,396

(22) Filed: Dec. 10, 2009

(65) Prior Publication Data

US 2010/0267464 A1 Oct. 21, 2010

(30) Foreign Application Priority Data

Apr. 20, 2009 (JP) ..... 2009-101741

(51) Int. Cl.
*A63B 53/12* (2006.01)

(52) U.S. Cl. ..... 473/320

(58) Field of Classification Search ..... 473/316, 473/320–323
See application file for complete search history.

(56) References Cited

U.S. PATENT DOCUMENTS

| | | | | | |
|---|---|---|---|---|---|
| 4,139,672 | A | * | 2/1979 | Ozawa et al. | 428/323 |
| 4,305,994 | A | * | 12/1981 | Murase | 428/704 |
| 4,981,759 | A | * | 1/1991 | Nakatani et al. | 428/626 |
| 5,681,226 | A | * | 10/1997 | Chambers, Jr. | 473/300 |
| 5,776,867 | A | * | 7/1998 | Przybylski et al. | 508/161 |
| 6,088,947 | A | | 7/2000 | Suzue et al. | |
| 6,165,621 | A | * | 12/2000 | Kasari et al. | 428/457 |
| 7,090,591 | B2 | * | 8/2006 | Sano | 473/324 |
| 2003/0201182 | A1 | * | 10/2003 | Nakamura et al. | 204/484 |
| 2004/0011429 | A1 | * | 1/2004 | Miyamoto et al. | 148/254 |

FOREIGN PATENT DOCUMENTS

| | | | |
|---|---|---|---|
| JP | 5-42236 | * | 2/1993 |
| JP | 10-005686 | A | 1/1998 |
| JP | 10-043334 | A | 2/1998 |
| JP | 2002-336393 | * | 11/2002 |
| JP | 2007-222550 | A | 9/2007 |
| JP | 2009-022448 | A | 2/2009 |

* cited by examiner

*Primary Examiner* — Stephen L. Blau
(74) *Attorney, Agent, or Firm* — Sughrue Mion, PLLC

(57) ABSTRACT

A golf club shaft has a more attractive appearance than a coating of plating and also achieves a rustproofing effect within the shaft, while avoiding the problem of an increase in weight and processing of effluents associated with plated shafts. The golf club shaft has a shaft body, a covering film formed by chemical treatment of an outside surface and an inside surface of the shaft body, a coating film layer formed by electric painting on the covering film of at least the outside surface; and a pigment layer, in which a polarizing powder is dispersed, which is coated on the coating film layer.

12 Claims, 1 Drawing Sheet

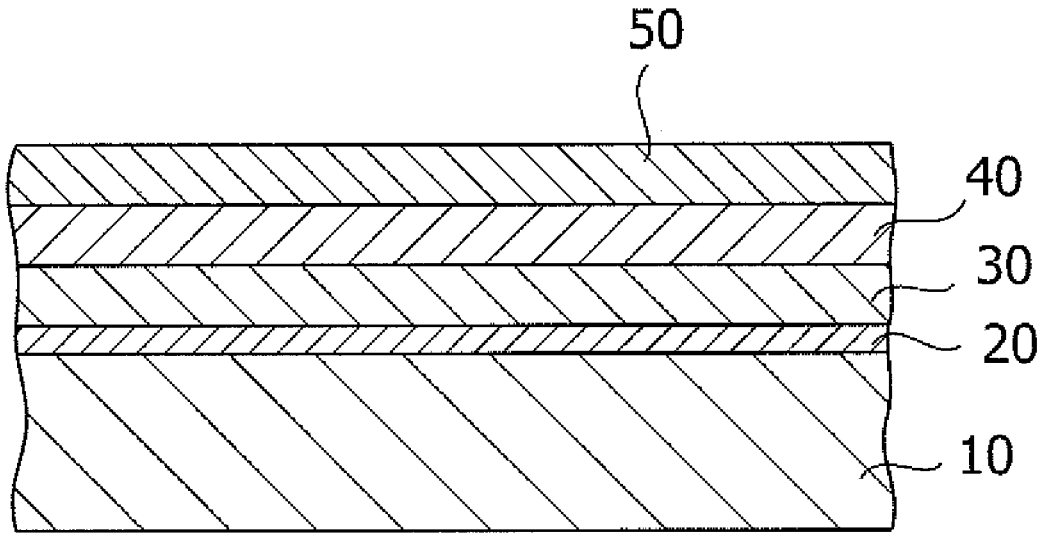
50
40
30
20
10

GOLF CLUB SHAFT

BACKGROUND OF THE INVENTION

The present invention relates to a golf club shaft having superior appearance.

Carbon, steel, and the like are used as materials for golf club shafts. In the case of a shaft made of steel, plating is used as a surface treatment to increase corrosion resistance. Japanese Unexamined Patent Application Publication No. 2009-22448 is known as a golf club shaft in which a steel shaft body is plated. This publication discloses the formation of a diamond-like carbon film having carbon as it main component on the surface of the plating layer for the purpose of improving the resistance to scratching and resistance to rusting.

In the case of plating, however, there is an appearance problem because there is no variation in the color of the surface of the shaft after plating. Also, because it is difficult to plate all of the inside of the shaft, there is the problem of internal rusting. Additionally, because the thickness of the plated coating film is great and because of a large amount of variation in thickness between products, the weight of the shaft exhibits an increase in the variation in weight, thereby adversely affecting the performance of a golf club incorporating such a shaft. In addition, as an environmental consideration there is the problem of the high cost of processing plating effluents.

SUMMARY OF THE INVENTION

The present invention was made with consideration given to the above-noted problems and has as an object to provide a golf club shaft that has a more attractive appearance than a coating of plating and that also achieves a rustproofing effect inside the shaft, while avoiding the problems of an increase in weight and processing of effluents associated with plated shafts.

To achieve the above-noted object, a golf club shaft according to the present invention has a shaft body, a covering film that is formed on the outside and inside surfaces of the shaft body by chemical treatment, a coated film layer formed by electric painting onto at least the outside covering film, and a pigment layer, which is coated onto the coating layer film, and in which is dispersed a polarizing powder.

According to one embodiment, a pearl pigment layer may be used as the pigment layer in which the polarizing powder is dispersed.

The thickness of the pearl pigment layer may be made approximately 10 micrometers or greater and no greater than approximately 50 micrometers.

According to another embodiment, an aluminum pigment layer may be used as the pigment layer in which the polarizing powder is dispersed.

The thickness of the aluminum pigment layer may be made approximately 1 micrometer or greater and approximately 5 micrometers or less.

According to yet another embodiment, a glass flake pigment layer may be used as the pigment layer in which the polarizing powder is dispersed.

The thickness of the glass flake pigment layer may be made approximately 50 micrometers.

Because a golf club shaft according to the present invention has a pigment layer in which is dispersed a polarizing powder formed on an electric painting layer over a chemically treated covering film, compared to plated golf club shafts of the past, it not only has a more attractive appearance and a rustproofing effect on the inside of the shaft, but also avoids the problems of an increase in the weight of the shaft and processing of effluents.

BRIEF DESCRIPTION OF THE DRAWINGS

FIG. 1 is a partial cross-sectional view of a golf club shaft according to an embodiment.

DESCRIPTION OF THE PREFERRED EMBODIMENTS

The manufacturing process for a golf club shaft of this embodiment can be divided into the four steps of chemical treatment, electric painting, coating of a pigment in which is dispersed a polarizing powder, and top coating processing.

FIG. 1 is a partial cross-sectional view of a golf club shaft of this embodiment. The shaft body 10 is made of a metal, and is particularly preferably made of steel or stainless steel. Although not shown, the shaft body is in the form of a pipe, with the inside of the pipe open to the outside at each end thereof. A head is fitted onto the distal end of the shaft body 10, and a grip made of rubber is inserted into the proximal end thereof. The shape of the shaft body 10 is formed so as to have a diameter that is increasingly tapered toward the distal end onto which is fitted the head.

In chemical treatment, which is one type of surface treatment, a metal material is immersed in a chemical treatment solvent to cause formation of a metal salt covering film on the surface thereof. There are various types of chemical treatment. For example, chromate treatment, ferrous-ferric oxide treatment, and zinc phosphate treatment.

Chromate treatment is a typical type of chemical treatment, which uses a chromate such as one of hexavalent chromium or the like. Ferrous-ferric oxide treatment is a treatment in which a solution made by adding a reaction accelerator and a dye to concentrated caustic soda is heated to boiling at approximately 140 degrees, a steel product that has been either degreased or derusted being immersed and heated therein, thereby causing the formation of a ferrous-ferric oxide covering film thereon.

Zinc phosphate treatment is a treatment in which a fine zinc phosphate covering film is caused to be formed on the surface of steel, thereby improving the adhesion of paint to the steel product, corrosion resistance, and the appearance. Zinc phosphate treatment is also suitable as pre-processing for electric painting, which will be described below.

In the chemical treatment process, chemical treatment is performed not only on the outside of the shaft body 10, but also on the inside thereof. As a result, in addition to the formation of a covering film 20 on the outside of the shaft body 10, although it is not shown, a similar covering film is formed on the inside of the shaft body 10. By doing this, it is possible to prevent rusting on the inside of the shaft. The covering film 20 provides blackening in the case of zinc phosphate processing.

Electric painting includes an electrostatic painting and an electrodeposition painting. Electrostatic painting is a process that provides coating material with ion charge by ion current between high electrostatic pressure plates and adsorbs the coating material onto a coated object through the electrostatic field. The features of electrostatic painting are that coating material loss is within 10 percent and that the resulting painted surface has no air bubbles and is even.

Electrodeposition painting is a type of painting in which an acrylic resin or a melamine resin is coated onto an object to be painted. Specifically, electrodeposition painting is a method whereby an object that is to be painted is placed in a tank containing a low-concentration aqueous resin paint, an electrode being provided in the tank, and a DC current being caused to flow between the electrode and the object to be painted, causing a paint film to be deposited onto the surface of the object being painted. There are two types of electrodeposition painting, anionic electrodeposition painting, in which the painted object is positive, and cationic electrodeposition painting, in which the painted object is negative. Acrylics and epoxies are commonly used types of paints.

In the electrodeposition painting process, cationic electrodeposition painting is performed on the outside surface of the shaft body 10 that has been passed through the chemical treatment as described above. As a result, a coating film layer 30 is formed over the covering film 20. The paint that is used in the electrodeposition coating is an epoxy that is suitable for the shaft, and the thickness of the coating film layer 30 is approximately 10 micrometers or greater. The upper limit of the thickness of the coating film layer 30 is approximately 20 micrometers, approximately 12 to approximately 18 micrometers being preferable, and approximately 15 micrometers being more preferable. Electrodeposition painting may also be performed on the inside surface of the shaft body 10. When this is done, it is preferable that it be performed at only the end part, and a more preferable example is one in which the range is up to approximately 10 cm from the end. Alternatively, the entire inside surface of the shaft may be electrodeposition painted. Because the chemically treated covering film is black, the coating film layer 30 that is electrodeposition coated is preferably one that has a deep coloring such as black, or no coloring, and black is particularly preferable.

To enhance the appearance of the shaft that has passed through the electric painting, a pigment in which a polarizing powder is dispersed is coated as a further process. As a result, a pigment layer 40 in which a polarizing powder is dispersed is formed on the coating film layer 30. As one example, a pearl pigment, in which a pearl powder is dispersed in a clear paint, may be coated, thereby forming a pearl pigment layer 40*a* on the coating film layer 30. Types of pearls include natural pearls or artificial pearls (for example, artificial mica or silica) and, while either may be used, of these, artificial mica is preferable. Also, the proportion by weight of pearl in the pearl pigment is approximately 0.1% or greater and less than approximately 20%. By making this less than approximately 20%, it is possible to achieve noticeable prevention of peeling of the pigment layer and coating film layer, that is, prevention of adhesion failure peeling. Also, by making this approximately 0.1% or greater, although the appearance of the shaft is enhanced, because an increase to approximately 5% or greater does not change the appearance of the shaft very much, it is particularly preferable that the percentage of pearl by weight in the pearl pigment be made approximately 0.1% or greater and less than approximately 5%. Also, the thickness of the pearl pigment layer 40*a* is from approximately 10 micrometers to approximately 50 micrometers.

An aluminum pigment may be used instead of the above-described pearl pigment. In this case, an aluminum pigment layer 40*b* is formed over the coating film layer 30. The aluminum pigment is a pigment in which an aluminum powder is dispersed in a clear paint, which is used to achieve a silver metallic color. When this is done, the cross-sectional thickness of the aluminum powder that is used is made approximately 0.03 micrometer or greater and no greater than approximately 0.05 micrometer. Also, the thickness of the aluminum pigment layer 40*b* is made approximately 1 micrometer or greater and no greater than approximately 5 micrometers, approximately 2 micrometers being preferable.

There are particle-type and flake-type aluminum powders (Surface Treatment Methods: Q&A 1000 editorial committee, *Surface Treatment Methods: Q&A* 1000, pp. 731 and 732, Industrial Technology Service Center). A wet-type boring mill method used in a solution is a method of making a flake pigment. According to this wet-type boring mill method, the crushing efficiency is high and is safe, and it is also possible to obtain a paste-type pigment of high quality. Paste pigments are generally used as pigments for paints and printing inks and the like. In the case of the wet-type boring mill method, an aluminum powder is placed into a boring mill together with an organic solvent and a surface reforming agent such as a fatty acid and is crushed into the form of flakes. A surface reforming agent is caused to mechanochemically adhere to the surface of the aluminum, this being used as a paste flake pigment. When this is done, the leafing form or non-leafing type occurs, depending upon the type of surface reforming agent and the thickness of the surface reforming agent layer that is adhered to the aluminum particles. When using a saturated fatty acid such as stearic acid that is caused to adhere to the surface in a layer of two to three molecules, the leafing type occurs. In contrast, if a non-saturated fatty acid such as oleic acid is used, the non-leafing type occurs.

In the case of using the leafing type for paint that is to be coated, because a continuous aluminum film is formed that floats to the surface of the coating film and is laminarly oriented in parallel, shininess is exhibited. In contrast, the non-leafing type does not float to the surface of the coating film and is dispersed and oriented with uniformity internally.

It is preferable to apply an aluminum pigment using the non-leafing type. In a different embodiment, a leafing type may be used.

In addition to the pearl pigment and the aluminum pigment as described above, a glass flake pigment may be used as a pigment in which a polarizing powder is dispersed. For example, a glass flake pigment in which glass flakes are dispersed in a clear paint may be coated to form a glass flake pigment layer 40*c* on the coating film layer 30. When this is done, the average particle diameter of the glass flake particles may be made approximately 10 micrometers or greater and no greater than approximately 40 micrometers. Also, the proportion by weight of glass flakes in the glass flake pigment is made approximately 0.1% or greater and less than approximately 20%. By making this less than approximately 20%, it is possible to achieve noticeable prevention of peeling of the pigment layer and coating film layer, that is, prevention of cohesion failure peeling. Also, by making this approximately 0.1% or greater, although the appearance of the shaft is enhanced, because an increase to approximately 5% or greater does not change the appearance of the shaft that much, it is particularly preferable that the percentage of pearl by weight in the pearl pigment be made approximately 0.1% or greater and less than approximately 5%. Also, the thickness of the glass flake pigment layer 40*c* is made approximately 50 micrometers.

In addition to the shaft becoming blackened, by the above-described chemical treatment, the surface of the shaft is still rough at this stage. At this point, by performing electric painting of either a deep achromatic color, such as black, or a deep chromatic color, the surface of the shaft is made smooth, and exhibits an attractive black coating film layer. Next, by coating onto the black coating film layer made by electric painting with a pigment in which is dispersed a polarizing powder such as a pearl pigment, an aluminum pigment, or a glass flake polarizing powder, an attractive coloring is achieved by the polarizing powder.

Finally, by performing top coating (clear coating) onto the shaft onto which is coated the pigment in which is dispersed the polarizing powder, a top coat 50 is formed on the pigment layer 40 in which a polarizing powder is dispersed. The above yields a golf club shaft with a good color and a superior appearance.

According to the embodiment described above, because the thicknesses of each of the formed layers is thin, there is little increase in the weight from the shaft body, and it is possible to avoid variations in weight between shafts during mass production.

The foregoing is a specific description of a golf club shaft according to the present invention. There is, however, no restriction to this embodiment, and the inventors view all variations and corrections thereto as being encompassed within the scope of the art of the present invention.

What is claimed is:

1. A golf club shaft comprising:

a shaft body;

a black covering film formed by chemical treatment of an outside surface and an inside surface of the shaft body;

a deep achromatic coating film layer formed by electric painting directly on the covering film of at least the outside surface; and a pigment layer, in which a polarizing powder is dispersed, which is coated directly on the coating film layer.

2. The golf club shaft according to claim 1, wherein the pigment layer in which the polarizing powder is dispersed is a pearl pigment layer.

3. The golf club shaft according to claim 2, wherein a thickness of the pearl pigment layer is approximately 10 micrometers to approximately 50 micrometers.

4. The golf club shaft according to claim 1, wherein the pigment layer in which the polarizing powder is dispersed is an aluminum pigment layer.

5. The golf club shaft according to claim 4, wherein a thickness of the aluminum pigment layer is approximately 1 micrometer to approximately 5 micrometers.

6. The golf club shaft according to claim 1, wherein the pigment layer in which the polarizing powder is dispersed is a glass flake pigment layer.

7. The golf club shaft according to claim 6, wherein a thickness of the glass flake pigment layer is approximately 50 micrometers.

8. The golf club shaft according to claim 1, wherein the coating film layer is black.

9. A golf club shaft comprising:

a shaft body;

a covering film formed by chemical treatment of an outside surface and an inside surface of the shaft body;

a coating film layer formed by electric painting directly on the covering film of at least the outside surface and a part of the inside surface; and a pigment layer, in which a polarizing powder is dispersed, which is coated directly on the coating film layer.

10. The golf club shaft according to claim 9, wherein the pigment layer in which the polarizing powder is dispersed is a pearl pigment layer.

11. The golf club shaft according to claim 10, wherein a thickness of the pearl pigment layer is approximately 10 micrometers to approximately 50 micrometers.

12. The golf club shaft according to claim 9, wherein the coating film layer is formed on the covering film on which the range is up to approximately 10 centimeters from the end at the inside of the shaft body.

* * * * *